United States Patent [19]

Tsuchiya et al.

[11] Patent Number: 5,032,192

[45] Date of Patent: Jul. 16, 1991

[54] PRODUCTION METHOD FOR A VEHICULAR ENDLESS TRACK BUSHING

[75] Inventors: Yasuo Tsuchiya; Masayoshi Kaneko, both of Chigasaki, Japan

[73] Assignee: Topy Kogyo Kabushiki Kaisha, Tokyo, Japan

[21] Appl. No.: 454,004

[22] Filed: Dec. 20, 1989

[30] Foreign Application Priority Data

Dec. 21, 1988 [JP] Japan ..... 63-320420

[51] Int. Cl.[5] ..... C21D 1/10

[52] U.S. Cl. ..... 148/16.5; 148/19

[58] Field of Search ..... 148/16.5, 19

[56] References Cited

FOREIGN PATENT DOCUMENTS 34806 6/1977 Japan .

259129 10/1989 Japan .

*Primary Examiner*—R. Dean

*Assistant Examiner*—Margen S. Phipps

*Attorney, Agent, or Firm*—Cushman, Darby & Cushman

[57] ABSTRACT

A production method for an endless track bushing wherein medium-carbon steel is selected as a bushing material, the bushing material is carburized, quench-hardened, and then tempered. In the quenching, the bushing material is induction-heated from an outside surface of the bushing material only. Due to the selection of medium-carbon steel, the carburizing time is reduced as compared with the case of low carbon steel. Further, due to the heating from the outside surface only, the induction-heating step is reduced to one-half of the case of heating from an outside surface of a bushing material and then from an inside surface of a bushing material.

7 Claims, 9 Drawing Sheets

PRODUCTION METHOD FOR A VEHICULAR ENDLESS TRACK BUSHING

BACKGROUND OF THE INVENTION

1. Field of the Invention

The present invention relates to a production method for a bushing used in an endless track mounted to vehicles.

2. Description of the Related Art

An endless track adapted to be mounted to vehicles includes, as shown in FIG. 1, a shoe 2, shoe connecting bolts 3, shoe nuts 4, rings 5 and 6, bushings 7, dust seals 8, and pins 9 as one structural unit thereof.

The bushing 7 used for an endless track is shown in FIG. 2 in an enlarged manner. For the endless track bushing, abrasion resistance is required at an inside surface 7*a*, an outside surface 7*b* and wall portions 7*c* adjacent the surfaces 7*a* and 7*b*, and strength and toughness are required at a core portion 7*d* of the wall to endure a load imposed on the bushing.

To satisfy those requirements, the following production methods of a endless track bushing have been proposed:

(a) A production method as proposed in Japanese Patent Publication SHO 52-3486, wherein case hardening steel (JIS (Japanese Industrial Standard): SCM415), which is a low carbon steel, is selected as the bushing material. The bushing material is carburized at portions near the surfaces thereof and is cooled in the furnace. Then, the bushing material is heated and quenched by oil, and then, the bushing material is tempered. The required hardness at the surfaces is obtained through the carburizing, and the required strength and toughness at the core portion are obtained through the quenching and tempering. This method will be called a first related art hereinafter. (b) A production method as proposed in Japanese Patent Application SHO 63-87338 proposed by the present applicant, (published as Japan 01-259,129) as shown in FIG. 3, wherein a bushing material 10 of medium-carbon steel is carburized, and then the bushing material is cooled to an ambient temperature;

the bushing material is induction-heated beyond an outer carburized layer from an outside surface 10*b* thereof while the bushing material 10 is rotated about an axis 10*a* thereof whereby an outer effective hardened layer having a hardness greater than a specified effective hardness is formed;

the bushing material is induction-heated beyond an inner carburized layer from an inside surface 10*c* thereof while the bushing material 10 is rotated about the axis 10a and the outside surface is cooled by liquid whereby an inner effective hardened layer having a hardness greater than the specified effective hardness is formed and a tempered layer having a hardness less than the specified effective hardness is formed between the inner and outer effective hardened layer; and the bushing is tempered at low temperatures. This method will be called a second related art hereinafter.

However, the first related art is relatively expensive as it takes a long time to carburize the bushing material because the case hardening steel includes is a low-carbon steel. The problem with the second related art is that it requires two steps in the induction heating because the bushing material is firstly induction-heated from the outside surface thereof and then from the inside surface thereof. Therefore, the hardening time is long.

OBJECT AND SUMMARY OF THE INVENTION

An object of the present invention is to provide a production method for an endless track bushing wherein a carburizing time is reduced as compared with the first related art and an induction heating step is reduced as compared with the second related art and wherein in spite of the reduction of the carburizing time and the induction heating step, abrasion resistance quality at surfaces, and strength and toughness at a core portion are maintained to the same order as those of the first and second related arts.

According to the present invention, the above-described object is attained by a production method for an endless track bushing wherein a bushing material of medium carbon steel (0.3-0.5% carbon content by weight) is carburized and then cooled to an ambient temperature. The bushing material is then induction-heated from an outside surface only and subsequently cooled to thereby harden the bushing material. After hardening, the bushing material is tempered at temperatures below 300° C.

The hardening may be performed through a stationary hardening method or a moving hardening method. In the stationary hardening method, the bushing material is rotated about an axis thereof within an induction heating coil, thereby heating an outside surface of the bushing material so that an entire wall cross-section is heated to a quenching temperature. An entire surface of the bushing material is then cooled by a quenching liquid so that the bushing material is evenly hardened. In the moving hardening method, the bushing material is rotated within an induction heating coil and axially moved relative to the induction heating coil. The bushing material is induction-heated from the outside surface thereof so that the entire wall cross-section is heated to the quenching temperature and then cooled by liquid flowing from a moving cooling jacket which follows the heating coil.

The present invention thus overcomes the problems of the known methods. Since the present invention uses medium-carbon steel for the material of the bushing, the carburizing time is reduced as compared with the first related art where low carbon steel is used. Further, since the entire cross-section of the wall is induction-heated from the outside surface only, the induction heating step is reduced to about one half of the second related art where the bushing material is induction-heated first from the outside surface and then from the inside surface thereof.

BRIEF DESCRIPTION OF THE DRAWINGS

The above and other objects, features and advantages of the present invention will become apparent and will be more readily appreciated from the following detailed description of the preferred exemplary embodiments of the invention taken in conjunction with the accompanying drawings, in which.

PREFERRED EMBODIMENT OF THE INVENTION

Figure 1:
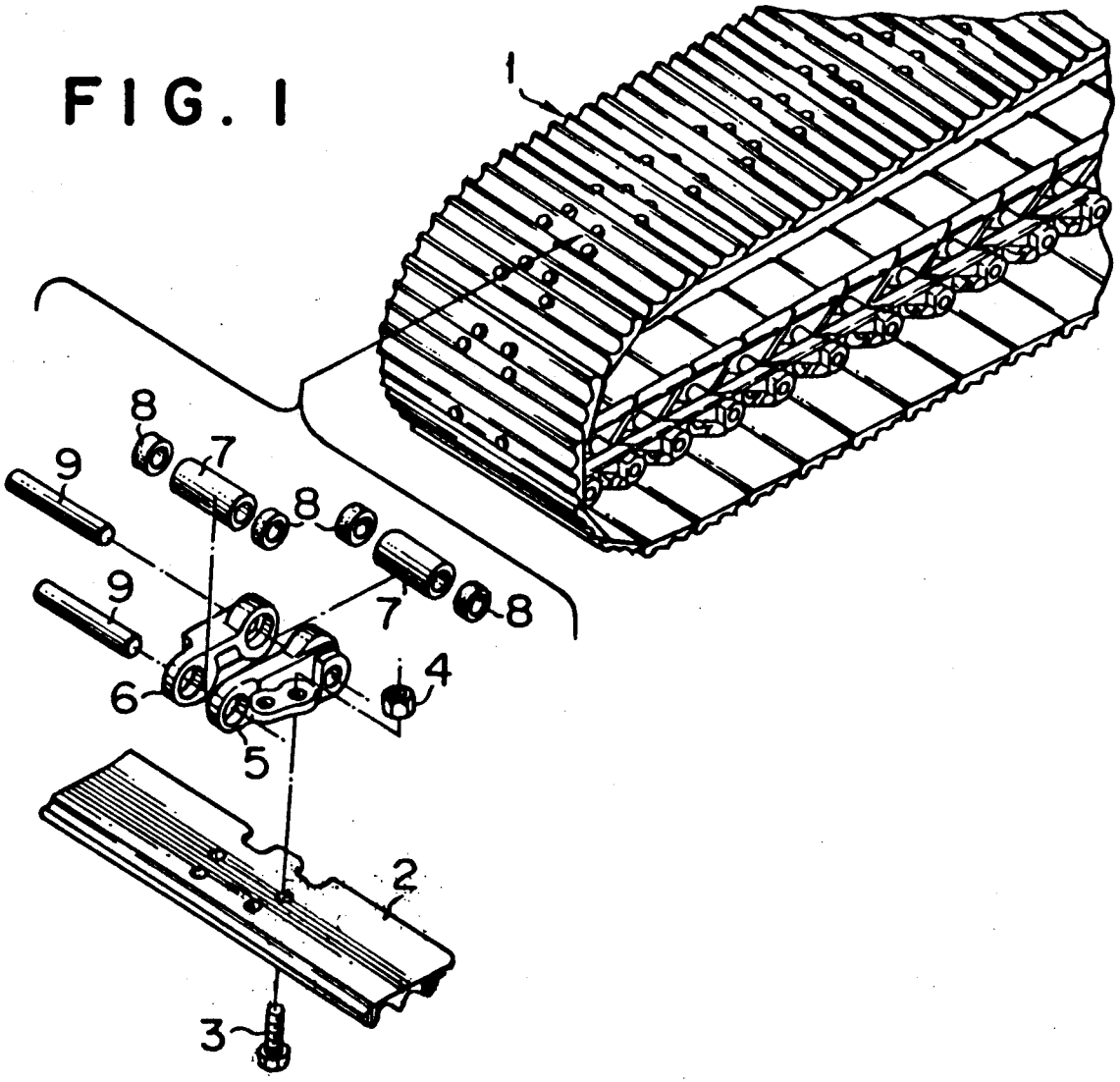
FIG. 1 is a perspective view of a portion of an endless track and the components thereof.
Figure 2:
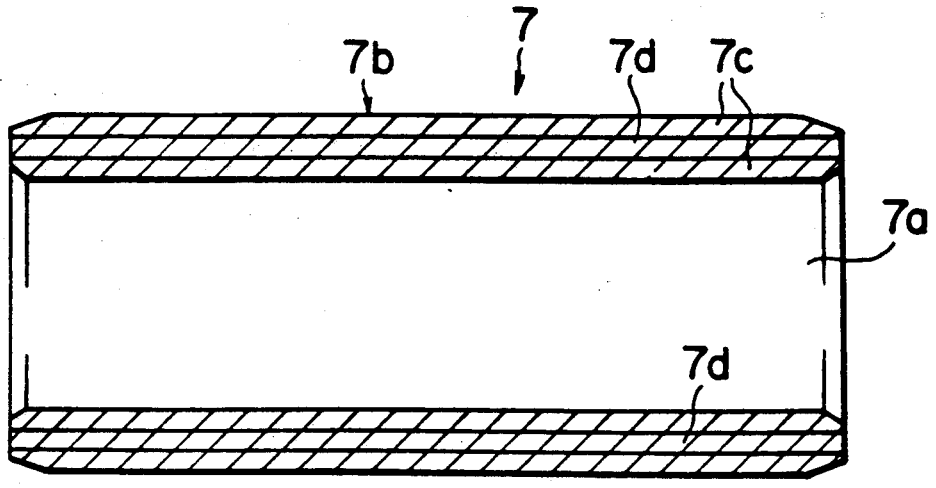
FIG. 2 is a cross-sectional view of a bushing heat-treated according to the first or second related art.
Figure 3:
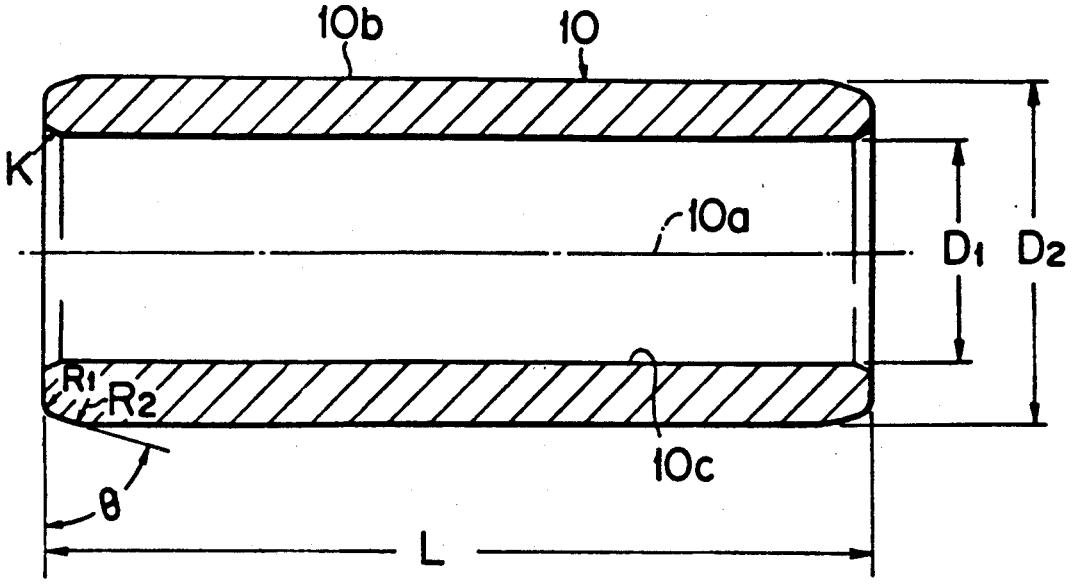
FIG. 3 is a cross-sectional view of a bushing heat-treated according to the present invention.

FIG. 3 illustrates a bushing material 10 to which the production method of the invention is applied. In a preferred embodiment, the bushing material 10 has a length L of 212 mm, an outer diameter D1 of 88.2 mm, an inner diameter D2 of 56.0 mm, an outside surface end taper $\theta$ of 75°, a taper corner having a radius R1, R2 of 2 mm, and an inside surface end chamfer K of 1mm.

The bushing material to be used in the production method of the present invention should comprise steel having a medium carbon content, more particularly, having 0.3–0.5% carbon content by weight. This would include steel defined as ASCB40H according to a Japanese Automobile Industry Association Standard. The chemical composition of ASCB40H is shown in Table 1. Table 1 also includes a chemical composition of JIS: SCM415 as used in the first related art for comparison.

TABLE 1

| Chemical Component | Steel Material: JIS: SCM415 (first related art) | Steel Material: ASCB40H (the present invention) |
|---|---|---|
| C | 0.16 (wt %) | 0.39 (wt %) |
| Si | 0.24 | 0.23 |
| Mn | 0.65 | 0.85 |
| P | 0.018 | 0.018 |
| S | 0.004 | 0.014 |
| Ni | 0.02 | 0.06 |
| Cr | 0.98 | 0.92 |
| Cu | 0.02 | 0.09 |
| Mo | 0.21 | 0.02 |
| Al | 0.032 | 0.019 |
| Ti | — | 0.039 |
| B | — | 0.0018 |

The bushing material having the above-described composition is heat-treated according to the heat treatment specifications shown in Table 2. It is important that a carburizing time n the method of the present invention is reduced, for example, to less than six hours as compared with that in the method of the first related art and that the bushing material is induction-heated from the outside surface only. Table 2 also shows the heat-treatment specifications of the first and second related arts for comparison.

TABLE 2

| Material | Method | Heat treatment | Details |
|---|---|---|---|
| SCM 415 | first related art | carburizing | 1040° C. * 14.3 hours cooling in a furnace |
| | | quenching | heating at 850° C. and cooling by oil |
| | | tempering | 200° C. |
| ASCB40H | second related art | carburizing | 1040° C. * 5.7 hours cooling in a furnace |
| | | quenching | induction-hardening from the outside surface and then from the inside surface |
| | | tempering | 200° C. |
| ASCB40H | the present invention | carburizing | 1040° C. * 5.7 hours |
| | | quenching | induction-hardening the entire wall from the outside surface |
| | | tempering | 200° C. |

The specification of the high frequency induction hardening of Table 2 is shown in more detail in Table 3. Table 3 also shows the second related art for comparison.

TABLE 3

| | Specifications: Second related art, Heating: From outside surface | Second related art, Heating: From inside surface | The present invention, Heating: From outside surface only |
|---|---|---|---|
| Frequency (Khz) | 3 | 10 | 1 |
| Output (Kw) | 50 | 70 | 70 |
| Heating method | moving heating | moving heating | stationary heating |
| Moving speed (m/sec) | 2.3 | 4.5 | — |
| Heating time (sec) | — | — | 96 |
| Cooling | moving cooling | moving cooling | stationary cooling in liquid |
| Coolant | water soluble coolant | water soluble coolant | water |

The bushing materials having the chemical compositions shown in Table 1 were heat-treated according to the specifications shown in Table 2 and Table 3. The bushing material which has been heat-treated will hereinafter be called a bushing.

The heat-treatment results, that is, the carburized layer depths and cross-section hardnesses of the bushings heat-treated according to the above-described specifications will be explained in detail below.

Figure 4:
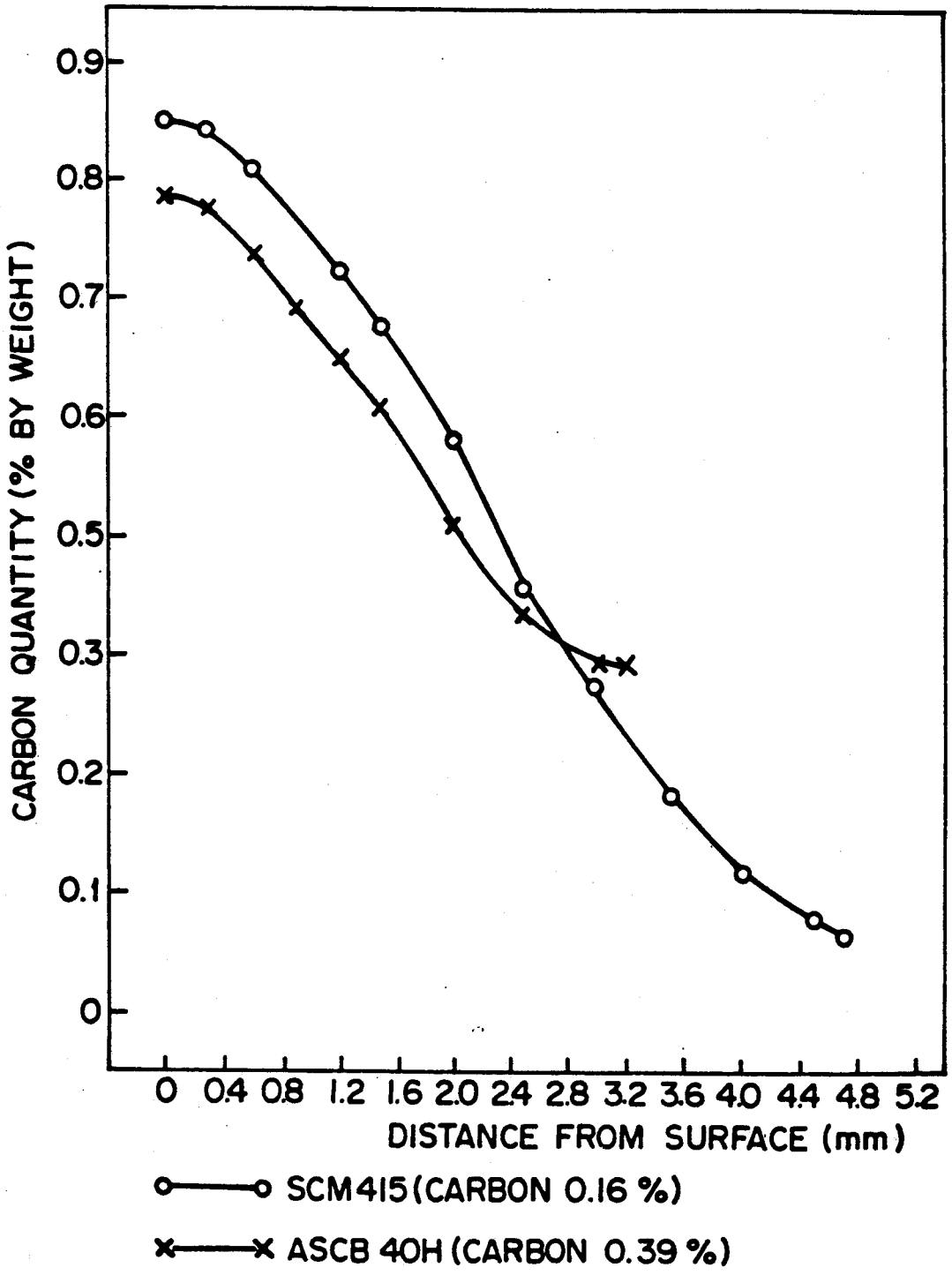
FIG. 4 is a graph illustrating a relationship between a carburizing depth and a carbon quantity.

FIG. 4 illustrates the carbon quantity included in the carburized layer of the bushings heat-treated according to the carburizing method of Table 2 and measured by an X-ray micro-analyzer. As seen in FIG. 4, the effective carburized layer of the bushing produced according to the method of the present invention has substantially the same depth as that of the bushing produced according to the method of the first related art, when it is defined that a carbon quantity to be included in an effective carburized layer is 0.4 % by weight.

Figure 5:
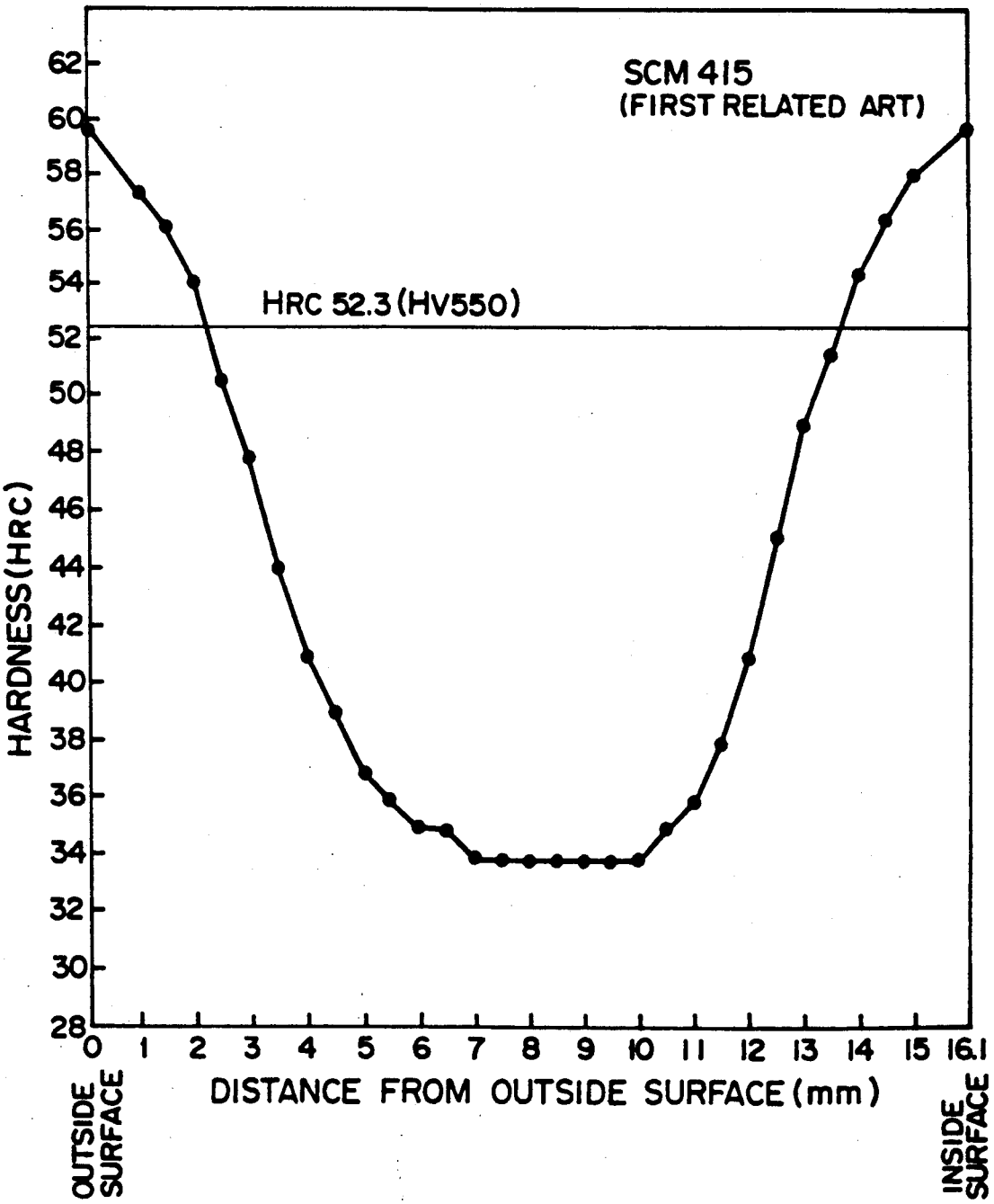
FIG. 5 is a graph illustrating a hardness distribution in a wall of a bushing heat-treated according to the first related art.

As seen in FIG. 5, the depth of the effective hardness layer of the bushing heat-treated according to the method of the first related art is 2.3–2.4 mm, when an effective hardness layer is defined as a layer having a hardness greater than Rockwell Hardness C-Scale 52.3 (Vickers Hardness Scale 550) according to JIS (Japanese Industrial Standard). The effective hardness layer depth is slightly less than the 2.8 mm depth of the carburized layer having at least 0.4% carbon by weight.

Figure 6:
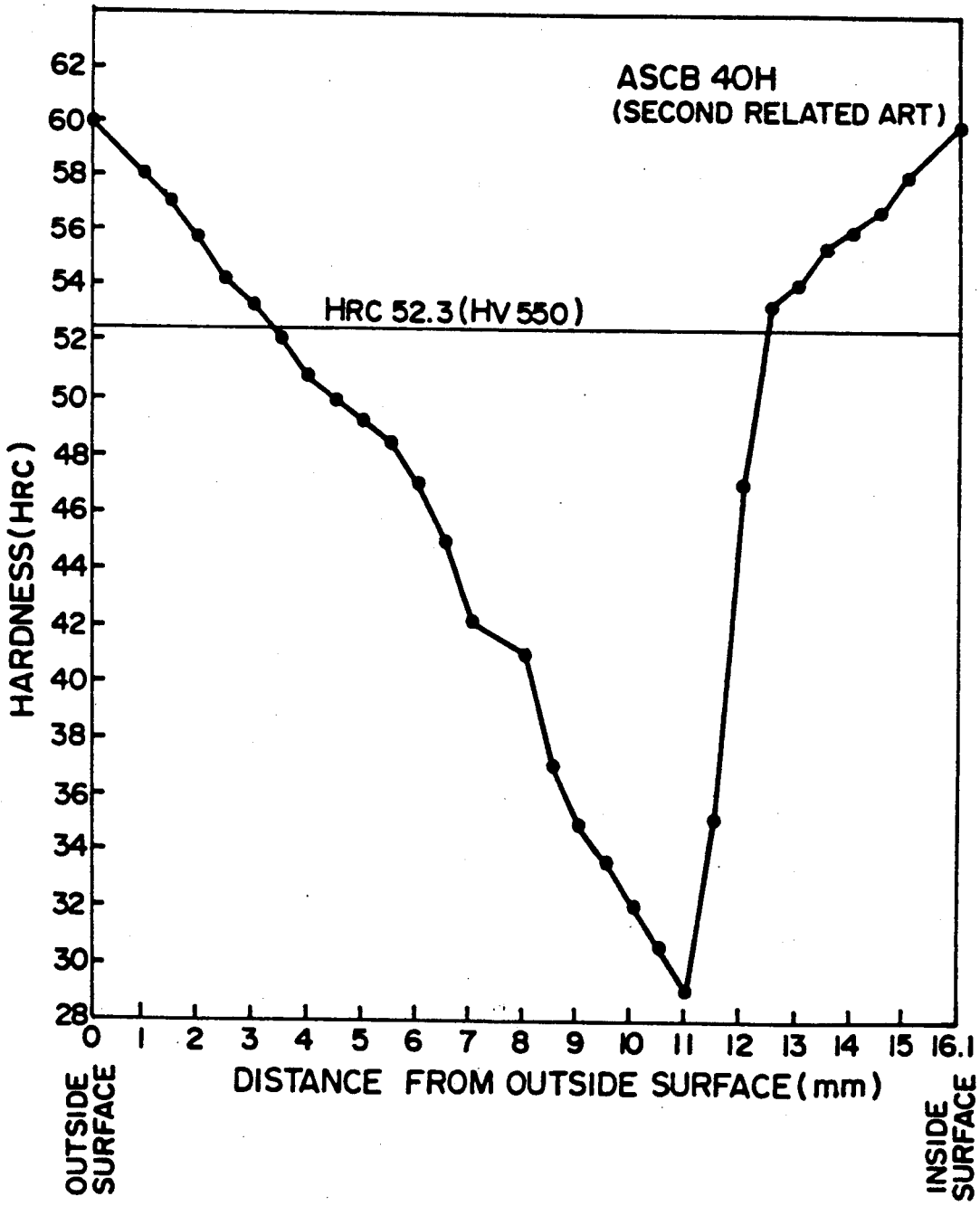
FIG. 6 is a graph illustrating a hardness distribution in a wall of a bushing heat-treated according to the second related art.

As seen in FIG. 6, the depth of the effective hardness layer of the bushing heat-treated according to the method of the second related art is 3.2–3.7 mm. The depth of the effective hardness layer is slightly greater than the 3.1 mm depth of the carburized layer having at least 0.4% carbon by weight. This means that hardening effect due to heat treating extends beyond the carburized layer in the carburizing of a bushing made from medium-carbon steel. The same effect can be seen in FIG. 7 illustrating the case of the present invention.

Figure 7:
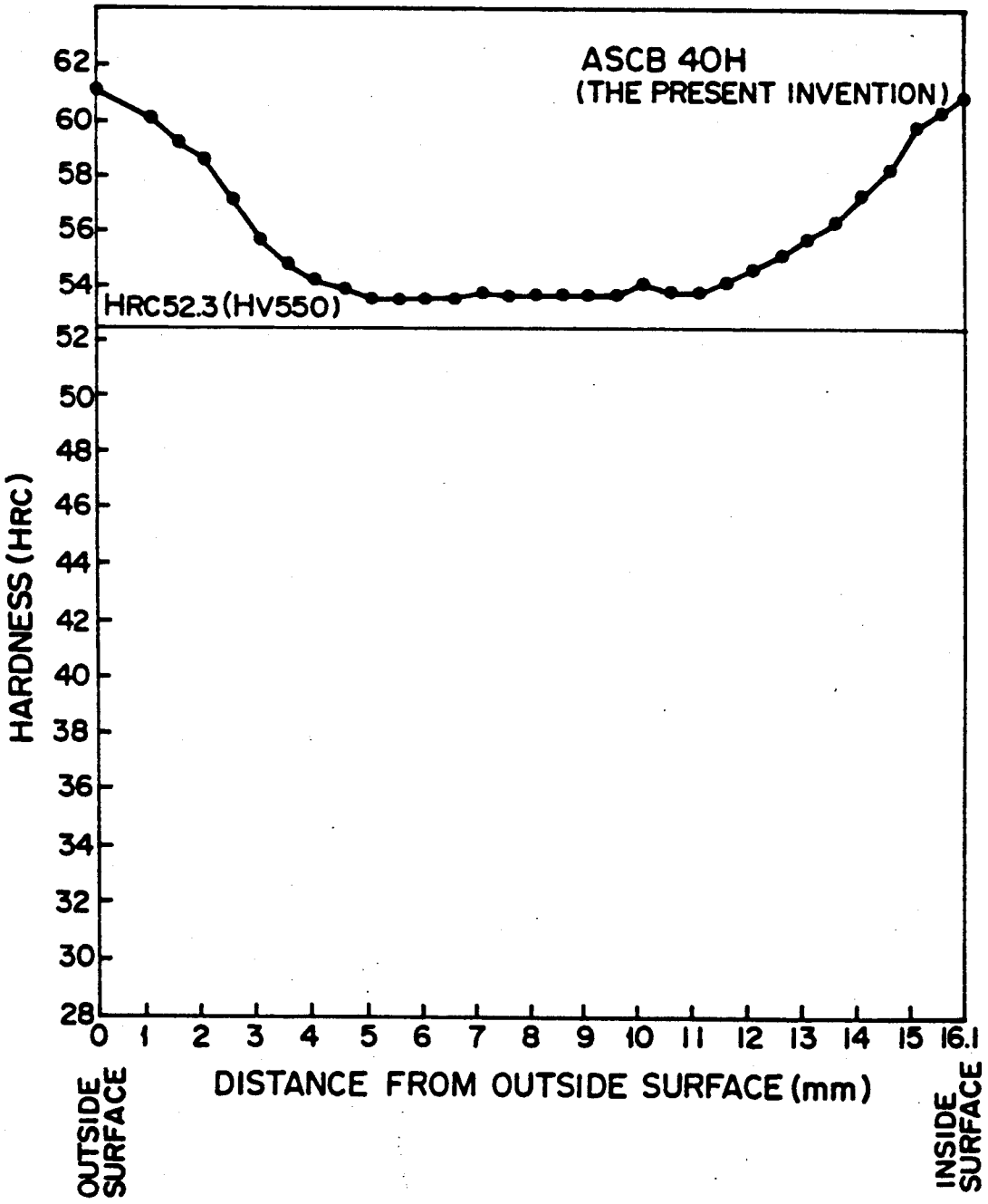
FIG. 7 is a graph illustrating a hardness distribution in a wall of a bushing heat-treated according to the present invention.

As seen in FIG. 7, the entire cross-section of the wall of the bushing is hardened to a hardness greater than $H_{RC}$ 52.3, though the carburized layer of the bushing heat-treated according to the method of the present invention is of substantially the same order as that of bushing heat-treated according to the method of the second related art.

Figure 8:
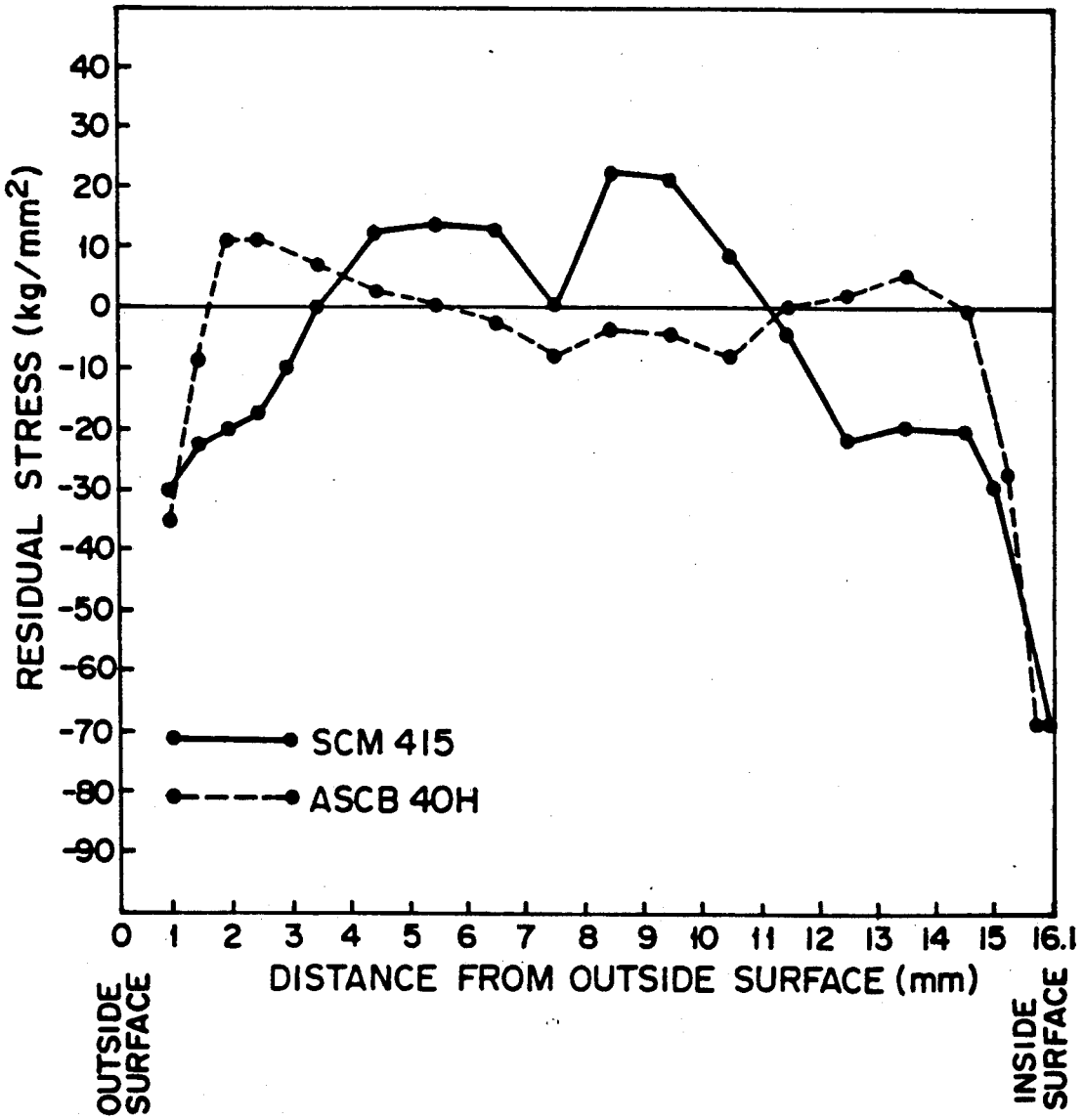
FIG. 8 is a graph illustrating a residual stress remaining in a wall of a bushing heat-treated according to the present invention and a residual stress according to the first related art.

FIG. 8 illustrates a comparison between a residual stress remaining in the bushing of SCM415 steel heat-treated according to the method of the first related art and a residual stress remaining in the bushing of ASCB40H steel heat-treated according to the method of the present invention. These residual stresses were measured by the Sack Method. In the case of case hardening steel SCM415, the surface of the bushing is in a compression state and the wall core of the bushing is in a tensile state. In the case of medium-carbon steel, the core portion of the wall of the bushing is in a slight compression state which contributes to placing the surface of the bushing in a compression state, though the surface could be in a tension state if the surface were not carburized. This compression of the surface improves the fatigue strength.

Figure 9A:
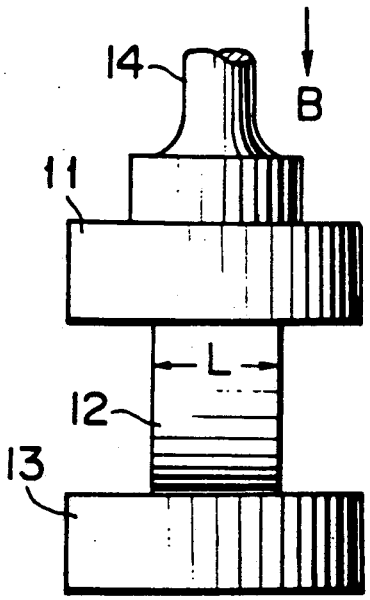
FIG. 9A is a front elevational view of a collapse test rig.
Figure 9B:
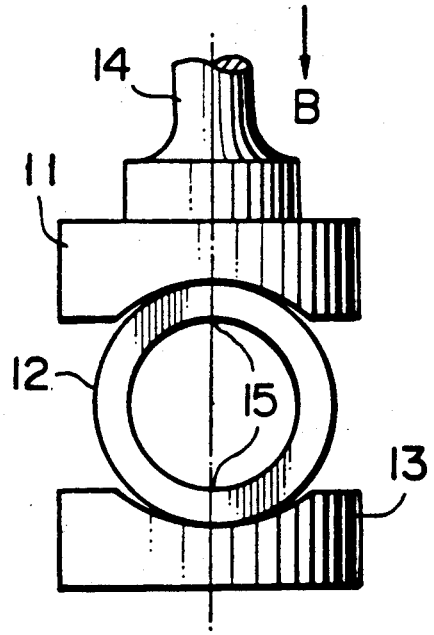
FIG. 9B is a side elevational view of the test rig of FIG. 9A.

FIG. 9 illustrates a collapse test rig. In the collapse test, the test piece was prepared by cutting the bushing having the configuration shown in FIG. 3 to a length L of 30 mm. The length of the test piece was determined from the capacity of the test rig and had no other technical meaning. The members denoted by reference numerals 11 and 13 are compressors to compress the test piece 12 therebetween. Member 13 is stationary while member 11 compresses in a direction shown by arrow B. The test rigs 11 and 13 were mounted to a compression force loading machine and a load was added in the direction B to cause a crack in the test piece at positions 15. A collapse load was defined as a maximum load before the crack initiated. A collapse deformation was defined as a deformation of the test piece at the time when the maximum load was loaded. Table 4 illustrates the test results.

TABLE 4

| Test piece | Collapse load | Collapse deformation |
|---|---|---|
| SCM 415 first related art | 23.0 (ton) | 1.88 (mm) |
| ASCB40H second related art | 25.1 | 1.89 |
| ASCB40H the present invention | 27.4 | 2.51 |

As seen in Table 4, the bushing heat-treated according to the method of the present invention has greater collapse load and deformation than those of the bushings heat-treated according to the methods of the first and second related arts. This means that the method of the present invention is preferable to the methods of the first and second related arts from the viewpoints of strength and toughness.

Figure 10A:
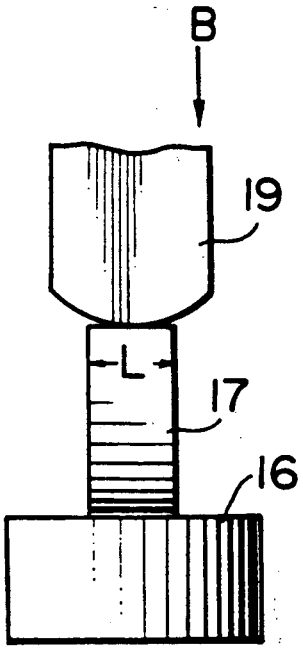
FIG. 10A is a front elevational view of a fatigue test rig.
Figure 10B:
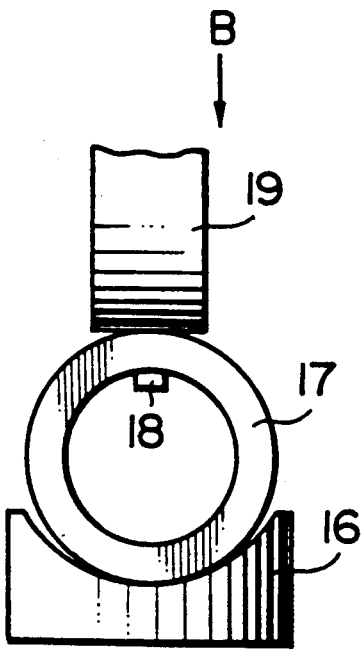
FIG. 10B is a side elevational view of the test rig of FIG. 10A.

FIG. 10 illustrates a test rig for testing fatigue strength. In the fatigue test, a test piece 17 was prepared by cutting the bushing to an appropriate length L of 20 mm. The length of 20 mm was determined by the capacity of the test rig and had no other meaning. The test piece 17 was supported on a supporting rig 16 and was repeatedly pushed by a pushing rig 19 in direction B. The repeating load cycles from zero stress to a stress having a stress ratio 0.05 which is 0.05% stress of the collapse stress. A crack initiation was detected by a probe 18 which was set at an inside surface of the test piece beneath the pushing rig 19. A fatigue life was evaluated from the loading repetition number at the time when a crack initiated.

Figure 11:
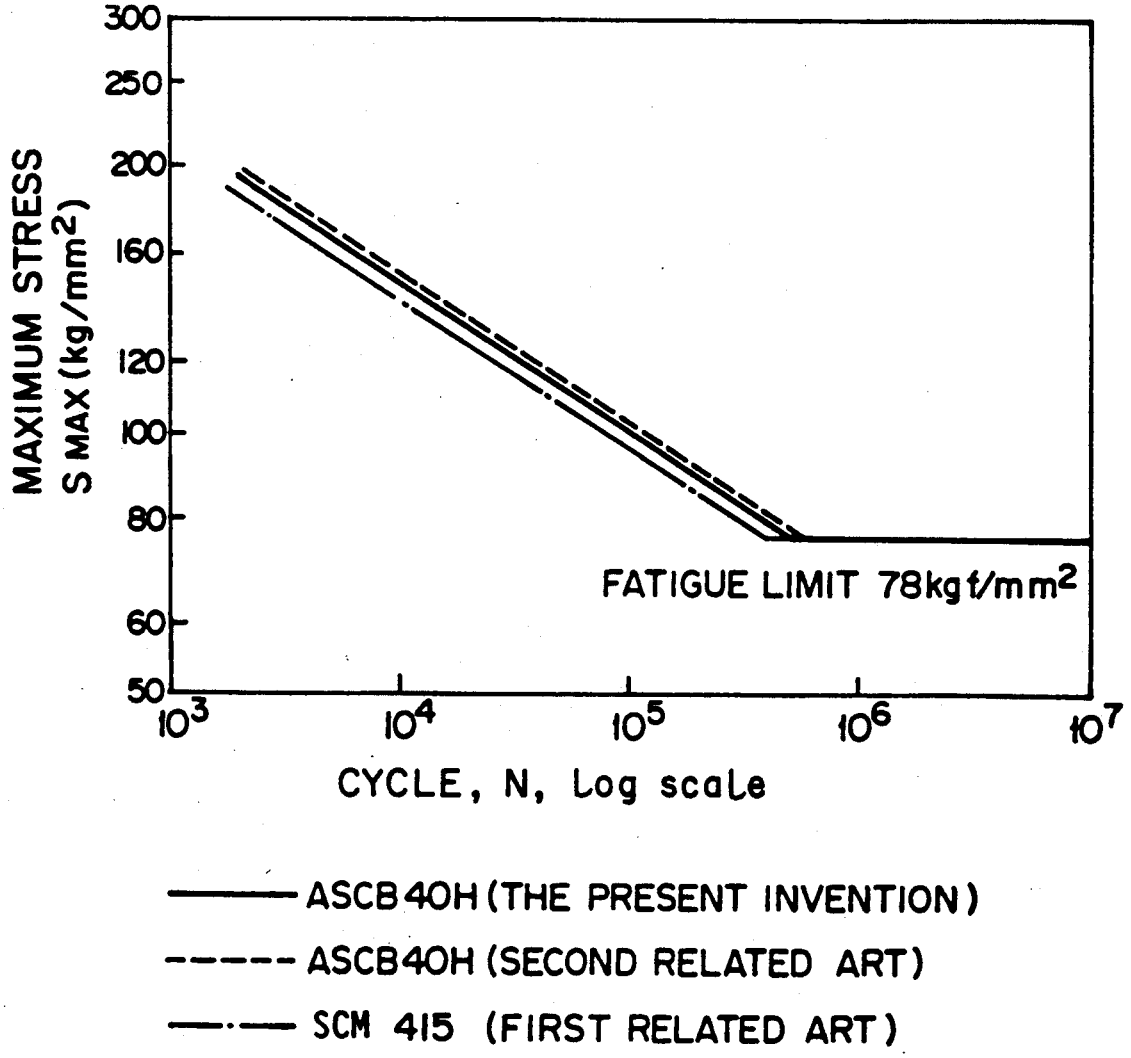
FIG. 11 is an S-N diagram illustrating fatigue test results of bushings heat-treated according to the present invention, and the first and second related arts.

FIG. 11 shows the fatigue test results in the form of an S-N diagram where S is the crack initiation stress and N is the loading repetition number. As seen in FIG. 11, the bushing heat-treated according to the method of the present invention provides substantially the same fatigue strength as those of the bushings heat-treated according to the methods of the first and second related arts. Since the first related art is used as a practical method, the method according to the present invention can also be said to be practical.

Several advantages can be obtained by use of the present invention.

First, because medium carbon steel (0.3–0.5% carbon content by weight) is selected as the bushing material, the carburizing time can be reduced as compared with that of the first related art where a case hardening steel is used as the bushing material, to obtain the same depth of the effective carburized layer.

Second, because induction heating is performed from an outside surface of a bushing material only and an entire wall cross-section is heated, the induction heating step is reduced to one half of that of the second related art.

Third, despite the carburizing time and induction heating step reduction, strength and toughness of the bushing are maintained generally equal to or greater than those of the bushings heat-treated according to the methods of the first and second related arts.

Fourth, though the hardness of a core portion of a bushing heat-treated according to the method of the first or second related art is less than the hardness defining the effective carburized layer, the hardness of the core portion of a bushing heat-treated according to the method of the present invention is greater than the hardness defining the effective carburized layer. As a result, abrasion resistance of the bushing produced according to the method of the present invention is conspicuously improved as compared with the bushings produced according to the methods of the first and second related arts.

Although only one embodiment of the present invention has been described above in detail, it will be appreciated by those skilled in the art that various modifications and alterations can be made to the particular embodiment shown without materially departing from the novel teachings and advantages of the present invention. Accordingly, it is to be understood that all such modifications and alterations are included within the spirit and scope of the invention as defined by the appended claims.

What is claimed is:

1. A production method for a vehicular endless track bushing comprising the steps of:

carburizing a bushing material of medium-carbon steel for a time;

cooling the bushing material to an ambient temperature;

induction-heating the bushing material from an outside surface of the bushing material only so that an entire cross-section of a wall of the bushing material is heated;

quenching the bushing material by cooling; and tempering the bushing material.

2. The method according to claim 1, wherein the steel used for the bushing material includes a carbon content of 03–0.5% by weight.

3. The method according to claim 1, wherein the time is less than or equal to 6 hours.

4. The method according to claim 1, wherein the carburizing is performed so that a surface adjacent portion of a wall of the bushing material is hardened to a hardness greater than $H_{RC}$ 52.3.

5. The method according to claim 1, wherein the tempering is performed at temperatures less than 300° C.

6. The method according to claim 1, wherein the quenching and tempering is performed so that the entire cross-section of the bushing material is hardened to a hardness greater than $H_{RC}$ 52.3.

7. The method according to claim 1, wherein the quenching and tempering is performed so that a compression residual stress remains at a core portion of a wall of the bushing material as well as at surfaces of the bushing material.

* * * * *